US005102478A

United States Patent [19]

Hosoya et al.

[11] Patent Number: 5,102,478

[45] Date of Patent: Apr. 7, 1992

[54] METHOD OF MAKING NON-ORIENTED MAGNETIC STEEL STRIPS

[75] Inventors: Yoshihiro Hosoya; Akihiko Nishimoto; Toshiaki Urabe, all of Tokyo, Japan

[73] Assignee: NKK Corporation, Tokyo, Japan

[21] Appl. No.: 748,180

[22] Filed: Aug. 20, 1991

Related U.S. Application Data

[63] Continuation-in-part of Ser. No. 468,573, Jan. 23, 1990, abandoned.

[30] Foreign Application Priority Data

Feb. 23, 1989 [JP] Japan ..... 1-41661

[51] Int. Cl.[5] ..... H01F 1/02

[52] U.S. Cl. ..... 148/111; 148/120

[58] Field of Search ..... 148/111, 120

[56] References Cited

U.S. PATENT DOCUMENTS 3,770,517 11/1973 Gray et al. ..... 148/111
4,306,922 12/1981 Coombs et al. ..... 148/111
4,666,534 5/1987 Miyoshi et al. ..... 148/111

*Primary Examiner*—John P. Sheehan
*Attorney, Agent, or Firm*—Nields & Lemack

[57] ABSTRACT

For enabling the making of non-oriented magnetic steel strips by direct rolling, the amounts of AlN and MnS which precipitate on the way of the direct rolling are decreased to such a level that they do not affect the magnetic properties by regulting the Al and S amounts, and further unavoidable precipitating nitrides are precipitated coarsely as BN. With regard to the steel composition, the amount of C, Si and P are not only regulated, but also the amounts of Mn, Al, S and N are regulated from the above standpoint, and a proper amount of B is added if required. In addition, in regard to treatment conditions, in order to secure necessary finishing and coiling temperatures, the lower limit of the slab temperature at the starting time of the direct rolling is specified. Moreover, to promote refining of ferrite, the upper limit of the finishing temperature is specified, and also to prevent non-uniform recrystallization after coiling, the upper limit of the coiling temperature is specified. Furthermore, to secure satisfied magnetic properties, the annealing of the hot rolled strip is performed under specific conditions determined by a soaking temperature and a soaking time. In addition, to secure the magnetic properties of the cold rolled strip, the strip is finally continuously annealed at determined temperatures.

6 Claims, 2 Drawing Sheets

Remarks : [*: difference between HDR products and ordinary HCR products on W15/50 ]

Remarks : [*: difference between HDR products and ordinary HCR products on $W_{15/50}$ ]

Remarks: [*: difference between HDR products and ordinary HCR products on $W_{15/50}$ ]

METHOD OF MAKING NON-ORIENTED MAGNETIC STEEL STRIPS

This application is a continuation-in-part of application Ser. No. 07/468,573, filed Jan. 23, 1990 now abandoned.

TECHNICAL FIELD

The present invention relates to a method of making non-oriented magnetic steel strips through a hot direct rolling (hereinafter referred to as "HDR").

Generally, HDR means, strictly speaking, a rolling method in which a cast slab is directly hot-rolled without heating. But the explanation of the invention also includes in HDR in a broad sense such a process that the cast slab is reheated before its temperature goes down remarkably and is hot-rolled (hot slab-reheating-rolling).

BACKGROUND OF THE INVENTION

As important factors governing properties of magnetic steel strips, there are amounts, sizes, morphology and distribution of AlN and MnS which precipitate in steel. They not only influence the magnetic properties of final products but also play important roles for the formation of the miscrostructure of the steel strips during a series of processing.

In the case of grain oriented silicon steel strips, the precipitates such as AlN and MnS are effectively utilized as inhibitors which control a secondary recrystallization. However, with respect to the non-oriented silicon steel strips, there have been disclosed technologies to make the precipitation harmless, as follows:

1. The slab is heated at low temperature so as to check resolution of AlN or MnS (e.g. Patent Publication No. 50-35885).

2. The amounts of S and O are decreased which produce fine precipitates of non-metallic inclusions (e.g. Patent Publication No. 56-22931).

3. Ca and REM are added to control morphology of sulfide inclusions (e.g. Patent Publications No. 58-17248 and No. 58-17249).

4. The steel strip is coiled at ultra high temperature after hot rolling so as to cause a self-annealing thereof, so that AlN is coarsened by self-annealing effect (Patent Publication No. 57-43132).

Most of these technologies are based on the premise of the conventional processes which consist of slab reheating and hot rolling. However, taking into consideration the employment of direct rolling which is regarded as promising in terms of energy- and process-savings, the above technologies alone are insufficient to obtain the excellent magnetic properties, because in the direct rolling, AlN or MnS finely precipitate in steel during the hot rolling process.

Therefore from the viewpoint of solving the above problems, as a method of coarsening AlN in HDR, technologies have been proposed to coarsen AlN by briefly heating the slab on the way of HDR as taught in Patent Publications No. 56-18045, No. 56-33451 and Laid-Open No. 58-123825. However, these techniques cause non-uniform precipitation of AlN in the thickness direction of the slab. Therefore those methods are not always sufficient for manufacturing magnetic steel strip of which uniformity of the property is important.

SUMMARY OF THE INVENTION

The present invention has been developed in view of the conventional problems as mentioned above. In order to realize HDR technique in a process of manufacturing the magnetic steel strip, the invention makes it possible to control the precipitation of AlN and MnS in HDR, which has been hitherto a difficult problem, by means of a claimed original component designation and a claimed prescription of treatment conditions. That is, the essence of the invention is to decrease the amounts of AlN and MnS precipitating during HDR to a level that they do not affect magnetic properties by regulating the Al and S contents, and also to have inevitably precipitating nitrides as coarse BN precipitate.

A first invention comprises the steps of starting a hot rolling on a continuously cast slab which is composed of C: not more than 0.01 wt %, Si: 1.0 to 4.0 wt %, Mn: 0.1 to 0.5 wt %, S: less than 0.005 wt %, Al: not more than 0.002 wt %, P: not more than 0.05 wt %, N: not more than 0.0030 wt %, the balance being Fe and unavoidable impurities, at a state that the surface temperature of the slab is not lower than 1000° C., or at a state while the surface temperature of the slab has not become lower than 1000° C. or at a state that the slab is reheated to not lower than 1000° C. before the surface temperature of the slab becomes lower than 600° C., and is then soaked at the temperature of not lower than 1000° C. for not less than 10 min, coiling at temperature which is not lower than 650° C. following accomplishing the hot-rolling at finishing temperature of 750° to 850° C., subsequently annealing the hot rolled steel strip at a soaking temperature T(°C.) and a soaking time t(min) to satisfy either the following conditions (1) or (2)

$$\left.\begin{array}{l} 770 \leqq T \leqq 890 \\ -100\ln t + 1170 \leqq T \leqq -100\ln t + 1431 \end{array}\right\} \quad (1)$$

$$\left.\begin{array}{l} 890 \leqq T \leqq 970 \\ -100\ln t + 979 \leqq T \leqq -100\ln t + 1069 \end{array}\right\} \quad (2)$$

subsequently performing a one-time cold rolling to said hot rolled steel strip, or performing cold rollings of more than once interposing process annealing(s) therebetween, and thereafter continuously annealing at a range between temperatures of 800° to 1050° C.

A second invention comprises carrying out a treatment under the same condition as above mentioned to a continuously cast slab which is composed of C: not more than 0.01 wt %, Si: 1.0 to 4.0 wt %, Mn: 0.1 to 0.5 wt %, S: less than 0.005 wt %, Al: not more than 0.01 wt %, P: not more than 0.05 wt %, N: not more than 0.0030 wt %, B: 0.5 to 2.0 in B(wt %)/N(wt %), the balance being Fe and unavoidable impurities.

There are two embodiments of the present invention. One embodiment relates to non B-addition steels; as to these non B-addition steels, the upper limit of Al is 0.002 wt %. The other embodiment relates to B-addition steels; as to these B-addition steels, the upper limit of Al is 0.01 wt %. In Table 1, Steels Nos. 1, 2, 6, 12 and 13 are non B-addition steels. The remaining steels in Table 1 are B-addition steels. As to the former, the upper limit of Al is 0.002 wt %, and so the asterisk after the "Sol.Al" entry for Steels Nos. 2 and 13 is correct. As to the latter, the upper limit of Al is 0.01%, and so the lack of an asterisk in the "Sol.Al" column for Steels Nos. 3, 4 and 9 is correct.

The present invention includes two alternative methods in carrying out the process from the slab casting until the hot rolling, as follows:

Method 1) The cast slab is directly rolled, while maintaining the temperature of not lower than 1000° C.

Method 2) Even if the cast slab becomes lower than 1000° C., the temperature is not allowed to be less than 600° C., and from this temperature range (600° ≦ temp. < 1000° C.), the cast slab is reheated to a temperature of not lower than 1000° C. and rolled.

Thus, the steel is not cooled to any temperature range. In other words, in the above method (1), the temperature of the steel never becomes lower than 1000° C. from the casting until the hot-rolling of the slab, and in the method (2), the temperature of the steel may be allowed to decrease down to 600° C.

After having been cast, the slab is never cooled to be lower than 600° C., and the hot-rolling is never started from a temperature of less than 1000° C.

"Continuous annealing" is performed on the finally cold-rolled steel plate, and should be distinguished from the intermediate annealings to be done in between the cold-rollings when a plurality of intermediate cold rolling steps are employed. In summary, the processes are as follows:

Cold-rolling (including the intermediate annealings in between the cold rollings when a plurality of cold-rolling steps are employed)

↓

Final continuous annealing

DETAILED DESCRIPTION OF THE INVENTION

The present invention will be explained in detail together with limiting reasons thereof.

The limiting reasons of the steel composition will be referred to.

C: The invention specifies the C content not more than 0.01 wt %, aiming at improving grain growth during annealing the hot rolled strip. In particular, in terms of magnetic aging, less than 0.005 wt % is preferable in the final products. For this purpose, a decarburization is carried out either by a vacuum-degassing treatment in the steelmaking or by a decarburization annealing during final annealing stage.

Si: In order to satisfy core loss values required to high-grade magnetic steel strips, the invention deals with such steels where not less than 1.0 wt % Si is added. However, if Si is added too much, it becomes impossible to carry out a cold-rolling, and wide applications become lacking in terms of the economics. Thus, the upper limit is 4.0 wt %.

Mn: When manufacturing the magnetic steel strip, Mn precipitates S as MnS during HDR. Therefore the amount of Mn is very important from the standpoint of its size control. To precipitate S sufficiently in the steel, the invention specifies the lower limit of Mn at 0.1 wt % and the upper limit at 0.5 wt % as the limit not exerting bad influences on the magnetic properties.

S: Aiming at regulating a total amount of MnS precipitation during HDR, S content is specified at less than 0.005 wt %.

Figure 1:
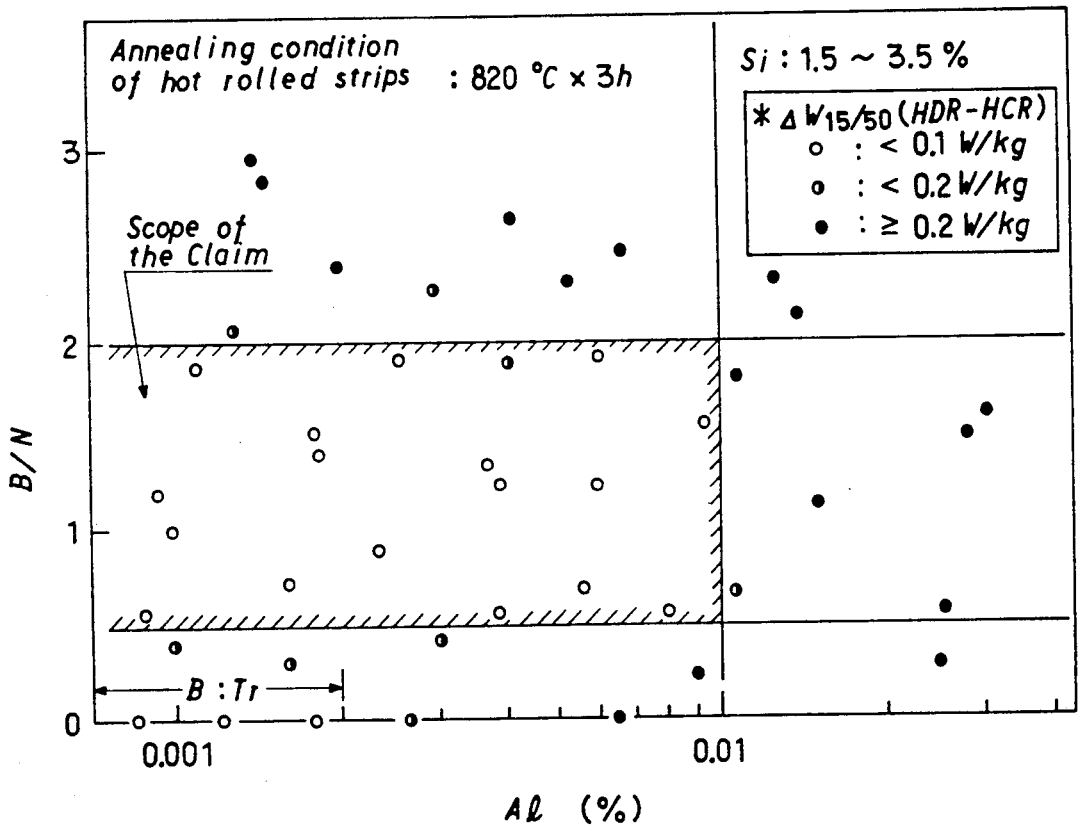
FIG. 1 shows a region of B/N where low core loss value are obtained, in a relation with the Al content.

Al: This is an important element in the invention. Contrary to the conventional technologies which aim at controlling the size and distribution of the AlN precipitates, the invention decreases Al extremely, aiming at lowering AlN to the level where it does not arouse problems over the magnetic properties. Thus, Al is regulated to not more than 0.002 wt %. Nevertheless, in a case of B addition as later mentioned, the excellent properties can be obtained by specifying Al at not more than 0.01 wt % as shown in FIG. 1.

P: This is a cheap and effective element to decrease the core loss of a low Si-magnetic steel strip. However, much addition not only makes the strip hard but also causes the slab cracking. Therefore its upper limit is 0.05 wt %.

N: This precipitates as fine AlN in the hot rolling process, and inhibits grain growth of ferrite not only in the hot rolled strip but in the cold rolled strip during final annealing. The invention is to check the precipitation of AlN as much as possible and to possibly precipitate it as BN by B addition as later mentioned, and specifies the upper limit of N at 0.0030 wt % to regulate the amounts of precipitation in both AlN and BN.

B: This is one of the most important elements in the invention. Particularly, by regulating the Al amount, B extremely decreases the amount of AlN which precipitates during HDR, and also makes N, which is unavoidably contained, precipitate as BN. FIG. 1 illustrates that a region of B/N, in which the low core loss value is obtained ($\Delta W_{15/50}$ is a difference in the core loss value between the HDR products and the conventionally HCR products) in relation with the Al content. When Al is not more than 0.01 wt % the low core loss value almost equivalent to that of the ordinary HCR products is obtained in the scope of B/N being 0.5 to 2.0. Thus, in the invention, B is added within the scope of B/N of 0.5 to 2.0.

In the present invention, the continuously cast slab having the composition as mentioned above is directly rolled, and a slab temperature (slab surface temperature, hereinafter referred to the same) at which the direct rolling starts is specified at not lower than 1000° C. Because if the starting temperature of the rolling is lower than 1000° C., it is difficult to secure the finishing and coiling temperatures specified by the invention, and insufficient to provide strain-induced precipitation in the hot rolling process as well as BN growth after the coiling. Moreover in the invention if the slab temperature becomes lower than 1000° C. after casting, the lower limit is specified at 600° C., and it is possible to perform the rolling by reheating the slab to not lower than 1000° C. from a temperature range of not lower than 600° C., so that the desired properties may be obtained. When the slab temperature decreases lower than 600° C., it is difficult to uniformly heat the slab into its interior by a short-time reheating treatment, and a slab soaking such as the conventional heat treatment becomes inevitable. In short, it spoils merits of the invention from an economical viewpoint. In addition, with respect to a soaking time when reheating the slab, the required properties may be obtained if securing not less than 10 minutes. Nevertheless if the soaking time is too long, it is not a good policy in terms of the economy. That is, the soaking for not more than 40 min is preferable.

In the hot-rolling, the finishing temperature is specified at not more than 850° C. to promote the refining of ferrite sufficiently. In addition, from the standpoint of rolling load in the hot rolling the lower limit of the finish temperature is specified at 750° C. Moreover, to avoid non-uniform recrystallization during slow cooling, a coiling temperature of the hot rolled strip is specified at lower than 650° C.

In the invention, the annealing of the hot rolled strip is indispensable after the hot rolling. This is because, prior to the cold rolling, the sufficient recrystallization of the hot rolled structure containing Si: not less than 1.0 wt % leads to a development of a desirable ferrite structure in terms of the magnetic properties. The annealing of the hot-rolled strip is carried out at a soaking temperature T(°C) and a soaking time t(min) satisfying one of the following conditions (1) and (2):

$$\left.\begin{array}{l} 770 \leqq T \leqq 890 \\ -100\ln t + 1170 \leqq T \leqq -100\ln t + 1431 \end{array}\right\} \quad (1)$$

$$\left.\begin{array}{l} 890 \leqq T \leqq 970 \\ -100\ln t + 979 \leqq T \leqq -100\ln t + 1069 \end{array}\right\} \quad (2)$$

Figure 2:
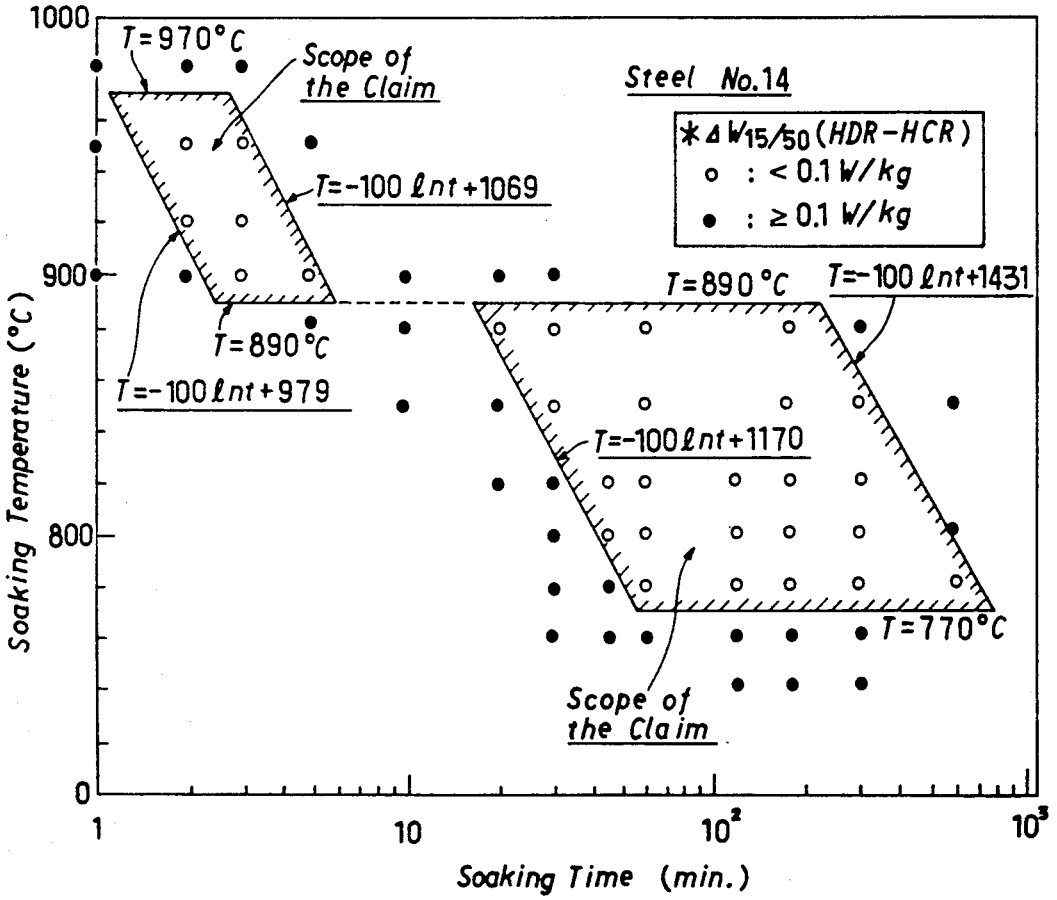
FIG. 2 shows regions of a soaking time and a soaking temperature where low core loss values are obtained in the annealing process of the hot-rolled strips.

FIG. 2 investigates the regions of the soaking time and the soaking temperature where the low core loss value ($W_{15/50}$ is a difference in the core loss value between HDR products and the ordinary HCR products) are obtained in the annealing process of the hot-rolled strip. In any regions other than the above, that is, at the soaking times and the soaking temperatures under their lower limits, a sufficiently recrystallized grain growth does not proceed. At the soaking time and temperature exceeding their upper limits, deteriorations of the magnetic properties arise due to coarsening of recrystallized grains and nitrogen absorption from the heating atmosphere. In either case, the core loss values equivalent to those of the ordinary HCR products cannot be obtained.

Moreover, in case of T>970° C., an abnormal grain growth of the ferrite grains occurs, and unevenness caused by coarse grains is produced on the cold rolled surface, resulting in a decrease of a space factor.

Furthermore, too long soaking time brings about the coarsening of the ferrite grains, a problem of nitriding arises at the strip surface in an ordinary annealing atmosphere, causing a core loss increase after the final annealing.

The hot-rolled steel strip is, according to the conventional process, continuously annealed at the temperature of 800° to 1050° C. after cold-rolling of once or more than once interposing the process annealing.

The above mentioned process annealing is usually performed at the soaking temperature of around 750° to 900° C. As to this annealing practice, either a batch annealing or a continuous annealing will do.

The final annealing is carried out by the continuous annealing. If the heating temperature is lower than 800° C., the grain growth is insufficient. On the other hand, if it exceeds 1050° C., ferrite grains grow excessively, resulting in a core loss increase.

EXAMPLE 1

The continuously cast slabs having the chemical compositions of Nos. 1, 3 and 14 shown in Table 1 were subjected to HDR (to thickness: 2.0 mm) under the conditions shown in Table 2, and annealed. Then, the rolled strips were pickled and cold-rolled to a thickness of 0.5 mm. The final annealing was performed to the strips in the continuously annealing line. The obtained magnetic properties of the strips are shown in Table 2.

EXAMPLE 2

The continuosuly cast slabs having the compositions of No. 14 shown in Table 1 were reheated and hot-rolled to a thickness of 2.0 mm under the conditions shown in Table 3 and annealed. The hot-rolled strips were pickled and cold-rolled to a thickness of 0.5 mm and the final annealing was applied to the strips in the continuous annealing line. The obtained magnetic properties of the strips are shown in Table 3.

EXAMPLE 3

The continuously cast slabs having the compositions shown in Table 1 were directly hot-rolled at the surface temperature of not lower than 1000° C. without introducing into the heating furnace, hot-rolled to a thickness of 2.0 mm at the finishing temperature between 780° and 820° C., coiled at the temperature of 560° to 610° C., and annealed under the conditions shown in Table 4. The hot-rolled strips were pickled and cold-rolled to a thickness of 0.5 mm. The obtained magnetic properties of the strips by the continuous annealing at the temperature shown in Table 4 are shown.

TABLE 1

| No. | Process Class. | C | Si | Mn | P | S. | Sol.Al | N | B | B/N |
|---|---|---|---|---|---|---|---|---|---|---|
| 1 | I | 0.0024 | 1.42 | 0.22 | 0.014 | 0.002 | 0.0018 | 0.0015 | — | 0 |
| 2 | C | 0.0023 | 1.45 | 0.25 | 0.015 | 0.002 | 0.005* | 0.0019 | — | 0 |
| 3 | I | 0.0020 | 1.45 | 0.24 | 0.022 | 0.002 | 0.004 | 0.0018 | 0.0020 | 1.11 |
| 4 | C | 0.0025 | 1.43 | 0.31 | 0.024 | 0.008* | 0.005 | 0.0020 | 0.0023 | 1.15 |
| 5 | C | 0.0027 | 1.50 | 0.23 | 0.019 | 0.003 | 0.035* | 0.0017 | 0.0024 | 1.41 |
| 6 | C | 0.0030 | 2.05 | 0.24 | 0.018 | 0.001 | 0.007* | 0.0016 | — | 0 |
| 7 | I | 0.0031 | 2.12 | 0.21 | 0.018 | 0.002 | 0.003 | 0.0021 | 0.0030 | 1.43 |
| 8 | C | 0.0029 | 2.06 | 0.20 | 0.015 | 0.002 | 0.002 | 0.0040* | 0.0022 | 0.55 |
| 9 | C | 0.0030 | 2.02 | 0.22 | 0.020 | 0.002 | 0.004 | 0.0017 | 0.0038 | 2.24* |
| 10 | C | 0.0031 | 2.03 | 0.22 | 0.022 | 0.003 | 0.002 | 0.0029 | 0.0012 | 0.41* |
| 11 | C | 0.0028 | 2.10 | 0.07* | 0.023 | 0.0045 | 0.003 | 0.0023 | 0.0024 | 1.04 |
| 12 | I | 0.0024 | 3.00 | 0.17 | 0.023 | 0.002 | 0.0013 | 0.0018 | — | 0 |
| 13 | C | 0.0024 | 3.02 | 0.19 | 0.025 | 0.002 | 0.004* | 0.0019 | — | 0 |
| 14 | I | 0.0025 | 3.01 | 0.18 | 0.022 | 0.001 | 0.001 | 0.0018 | 0.0023 | 1.28 |
| 15 | C | 0.0026 | 3.05 | 0.20 | 0.019 | 0.002 | 0.003 | 0.0017 | 0.0052 | 3.06* |

TABLE 1-continued

| No. | Process Class | C | Si | Mn | P | S. | Sol.Al | N | B | B/N |
|---|---|---|---|---|---|---|---|---|---|---|
| 16 | C | 0.0027 | 3.05 | 0.21 | 0.018 | 0.002 | 0.045* | 0.0018 | 0.0030 | 1.67 |

Remarks
I steel invented.
C steel for comparison.
*out of scope of the claims

TABLE 2

| No. | Process Class. | Starting Temperature of Direct Rolling (°C.) | Finishing Temperature (°C.) | Coiling Temperature (°C.) | Annealing Condition of Hot Rolled Strips | Final Annealing Temperature (°C.) | Magnetic Properties of Product $B_{50}$(T) | $W_{15/50}$ (w/Kg) |
|---|---|---|---|---|---|---|---|---|
| 1 | I | 1120 | 820 | 600 | 780° C. × 3 h | 850 | 1.79 | 350 |
| | C | 980* | 780 | 600 | 780° C. × 3 h | 850 | 1.77 | 3.91 |
| | C | 1100 | 720* | 550 | 780° C. × 3 h | 850 | 1.74 | 3.85 |
| 3 | I | 1150 | 810 | 610 | 800° C. × 3 h | 880 | 1.78 | 3.65 |
| | C | 970* | 760 | 590 | 800° C. × 3 h | 880 | 1.75 | 3.66 |
| | C | 1070 | 720* | 580 | 800° C. × 3 h | 880 | 1.74 | 3.70 |
| | C | 1150 | 820 | 760* | —* | 880 | 1.69 | 4.35 |
| 14 | I | 1080 | 790 | 600 | 850° C. × 3 h | 950 | 1.69 | 2.46 |
| | C | 1080 | 790 | 610 | 750° C. × 10 h* | 950 | 1.63 | 3.15 |
| | C | 1080 | 790 | 600 | 820° C. × 0.5 h* | 950 | 1.68 | 2.98 |
| | C | 940* | 750 | 590 | 850° C. × 3 h | 950 | 1.65 | 3.05 |

Remarks
I example of present invention.
C example for comparison.
*out of the scope of the claims

TABLE 3

| No. | Process Classification | Slab Reheating Conditions: Starting Reheating Temperature (°C.) | Reheating Temperature (°C.) | Soaking Time (min.) | Hot Rolling Conditions: Starting Rolling Temperature (°C.) | Finishing Temperature (°C.) | Coiling Temperature (°C.) | Annealing Condition of Hot Rolled Strips | Magnetic Properties of Product $B_{50}$ (T) | $W_{15/50}$ (w/Kg) |
|---|---|---|---|---|---|---|---|---|---|---|
| 14 | I | 700 | 1120 | 30 | 1070 | 800 | 590 | 950° C. × 2 min | 1.70 | 2.42 |
| | C | 300* | 1120 | 30 | 1070 | 800 | 590 | 950° C. × 2 min | 1.68 | 2.73 |
| | C | 800 | 1100 | 60 | 960* | 800 | 590 | 950° C. × 2 min | 1.65 | 3.02 |
| | C | 800 | 1100 | 60 | 1020 | 800 | 590 | 950° C. × 1 min* | 1.65 | 3.23 |

Remarks
I example of present invention
C example for comparison
*out of the scope of the claims

TABLE 4

| No. | Annealing Condition of Hot Rolled Strips | Final Annealing Temperature (°C.) | Magnetic Properties of Product $B_{50}$ (T) | $W_{15/50}$ (w/Kg) |
|---|---|---|---|---|
| 1 | 900° C. × 3 min | 880 | 1.81 | 3.55 |
| 2 | 900° C. × 3 min | 880 | 1.78 | 3.71 |
| 3 | 900° C. × 3 min | 880 | 1.80 | 3.60 |
| 4 | 900° C. × 3 min | 880 | 1.75 | 4.25 |
| 5 | 900° C. × 3 min | 880 | 1.74 | 4.31 |
| 6 | 820° C. × 6 h | 900 | 1.70 | 2.99 |
| 7 | 820° C. × 6 h | 900 | 1.75 | 3.01 |
| 8 | 820° C. × 6 h | 900 | 1.73 | 3.57 |
| 9 | 820° C. × 6 h | 900 | 1.71 | 4.15 |
| 10 | 820° C. × 6 h | 900 | 1.72 | 3.00 |
| 11 | 820° C. × 6 h | 900 | 1.71 | 4.07 |
| 12 | 850° C. × 3 h | 950 | 1.70 | 2.38 |
| 13 | 850° C. × 3 h | 950 | 1.65 | 2.47 |
| 14 | 850° C. × 3 h | 950 | 1.69 | 2.45 |
| 15 | 850° C. × 3 h | 950 | 1.67 | 3.15 |
| 16 | 850° C. × 3 h | 950 | 1.66 | 3.27 |

We claim:

1. A method of manufacturing non-oriented magnetic steel strips, comprising the steps of starting a hot rolling on a continuously cast slab which is composed of C: not more than 0.01 wt %, Si: 1.0 to 4.0 wt %, Mn: 0.1 to 0.5 wt %, S: less than 0.005 wt %, Al: not more than 0.002 wt %, P: not more than 0.05 wt %, N: not more than 0.0030 wt %, the balance being Fe and unavoidable impurities, at a state while the surface temperature of the slab has not become lower than 1000° C., or at a state that the slab is reheated to not lower than 1000° C. before the surface temperature of the slab becomes lower than 600° C., and is then soaked at the temperature of not lower than 1000° C. for not less than 10 min, coiling at temperature which is lower than 650° C. following accomplishing the hot-rolling at finishing temperature of 750° to 850° C., subsequently annealing the hot rolled steel strip at a soaking temperature T (°C.) and a soaking time t (min) to satisfy either the following conditions (1) or (2):

$$\left.\begin{array}{l} 770 \leqq T \leqq 890 \\ -100\ln t + 1170 \leqq T \leqq -100\ln t + 1431 \end{array}\right\} \quad (1)$$

$$\left.\begin{array}{l} 890 \leqq T \leqq 970 \\ -100\ln t + 979 \leqq T \leqq -100\ln t + 1069 \end{array}\right\} \quad (2)$$

subsequently performing a one-time cold rolling to said hot rolled steel strip, or performing cold rollings of more than once interposing process annealing(s) therebetween, and thereafter continuously annealing at a range between temperatures of 800° to 1050° C.

2. A method of manufacturing non-oriented magnetic steel strips, comprising the steps of starting a hot rolling on a continuously cast slab which is composed of C: less than 0.005 wt %, Si: 1.0 to 4.0 wt %, Mn: 0.1 to 0.5 wt %, S: less than 0.005 wt %, Al: not more than 0.002 wt %, P: not more than 0.05 wt %, N: not more than 0.0030 wt %, the balance being Fe and unavoidable impurities, at a state while the surface temperature of the slab has not become lower than 1000° C., or at a state that the slab is reheated to not lower than 1000° C. before the surface temperature of the slab becomes lower than 600° C., and is then soaked at the temperature of not lower than 1000° C. for not less than 10 min, coiling at temperature which is lower than 650° C. following accomplishing the hot-rolling at finishing temperature of 750° to 850° C., subsequently annealing the hot rolled steel strip at a soaking temperature T (°C.) and a soaking time t (min) to satisfy either th following conditions (1) or (2):

$$\left.\begin{array}{l} 770 \leqq T \leqq 890 \\ -100\ln t + 1170 \leqq T \leqq -100\ln t + 1431 \end{array}\right\} \quad (1)$$

$$\left.\begin{array}{l} 890 \leqq T \leqq 970 \\ -100\ln t + 979 \leqq T \leqq -100\ln t + 1069 \end{array}\right\} \quad (2)$$

subsequently performing a one-time cold rolling to said hot rolled steel strip, or performing cold rollings of more than once interposing process annealing(s) therebetween, and thereafter continuously annealing at a range between temperatures of 800° to 1050° C.

3. A method of manufacturing non-oriented magnetic steel strips, comprising the steps of starting a hot rolling on a continuously cast slab which is composed of C: not more than 0.01 wt %, Si: 1.0 to 4.0 wt %, Mn: 0.1 to 0.5 wt %, S: less than 0.005 wt %, Al: not more than 0.002 wt %, P: not more than 0.05 wt %, N: not more than 0.0030 wt %, the balance being Fe and unavoidable impurities, at a state while the surface temperature of the slab has not become lower than 1000° C., or at a state that the slab is reheated to not lower than 1000° C. before the surface temperature of the slab becomes lower than 600° C., and is then soaked at the temperature of not lower than 1000° C. for not less than 10 min, coiling at temperature which is lower than 650° C. following accomplishing the hot-rolling at finishing temperature of 750° to 850° C., subsequently annealing the hot rolled steel strip at a soaking temperature T (°C.) and a soaking time t (min) to satisfy either the following conditions (1) or (2):

$$\left.\begin{array}{l} 770 \leqq T \leqq 890 \\ -100\ln t + 1170 \leqq T \leqq -100\ln t + 1431 \end{array}\right\} \quad (1)$$

$$\left.\begin{array}{l} 890 \leqq T \leqq 970 \\ -100\ln t + 979 \leqq T \leqq -100\ln t + 1069 \end{array}\right\} \quad (2)$$

subsequently performing a one-time cold rolling to said hot rolled steel strip, or performing cold rollings of more than once interposing process annealing(s) therebetween, and thereafter continuously annealing serving as a decarburization annealing at a range between temperatures of 800° to 1050° C., thereby to decrease the C content less than 0.005 wt %.

4. A method of manufacturing non-oriented magnetic steel strips, comprising the steps of starting a hot rolling on a continuously cast slab which is composed of C: not more than 0.01 wt %, Si: 1.0 to 4.0 wt %, Mn: 0.1 to 0.5 wt %, S: less than 0.005 wt %, Al: not more than 0.01 wt %, P: not more than 0.05 wt %, N: not more than 0.0030 wt %, B: 0.5 to 2.0 in B(wt %)/N(wt %), the balance being Fe and unavoidable impurities, at a state while the surface temperature of the slab has not become lower than 1000° C., or at a state that the slab is reheated to not lower than 1000° C. before the surface temperature of the slab becomes lower than 600° C., and is then soaked at the temperature of not lower than 1000° C. for not less than 10 min, coiling at temperature which is lower than 650° C. following accomplishing the hot-rolling at finishing temperature of 750° to 850° C., subsequently annealing the hot rolled steel strip at a soaking temperature T (°C.) and a soaking time t (min) to satisfy either the following conditions (1) or (2):

$$\left.\begin{array}{l} 770 \leqq T \leqq 890 \\ -100\ln t + 1170 \leqq T \leqq -100\ln t + 1431 \end{array}\right\} \quad (1)$$

$$\left.\begin{array}{l} 890 \leqq T \leqq 970 \\ -100\ln t + 979 \leqq T \leqq -100\ln t + 1069 \end{array}\right\} \quad (2)$$

subsequently performing a one-time cold rolling to said hot rolled steel strip, or performing cold rollings of more than once interposing process annealing(s) therebetween, and thereafter continuously annealing at a range between temperatures of 800° to 1050° C.

5. A method of manufacturing non-oriented magnetic steel strips, comprising the steps of starting a hot rolling on a continuously cast slab which is composed of C: less than 0.005 wt %, Si: 1.0 to 4.0 wt %, Mn: 0.1 to 0.5 wt %, S: less than 0.005 wt %, Al: not more than 0.01 wt %, P: not more than 0.05 wt %, N: not more than 0.0030 wt %, B: 0.5 to 2.0 in B(wt %)/N(wt %), the balance being Fe and unavoidable impurities, at a state while the surface temperature of the slab has not become lower than 1000° C., or at a state that the slab is reheated to not lower than 1000° C. before the surface temperature of the slab becomes lower than 600° C., and is then soaked at the temperature of not lower than 1000° C. for not less than 10 min, coiling at temperature which is lower than 650° C. following accomplishing the hot-rolling at finishing temperature of 750° to 850° C., subsequently annealing the hot rolled steel strip at a soaking temperature T (°C.) and a soaking time t (min) to satisfy either the following conditions (1) or (2):

$$\left.\begin{array}{l} 770 \leqq T \leqq 890 \\ -100\ln t + 1170 \leqq T \leqq -100\ln t + 1431 \end{array}\right\} \quad (1)$$

$$\left.\begin{array}{l} 890 \leqq T \leqq 970 \\ -100\ln t + 979 \leqq T \leqq -100\ln t + 1069 \end{array}\right\} \quad (2)$$

subsequently performing a one-time cold rolling to said hot rolled steel strip, or performing cold rollings of more than once interposing process annealing(s) therebetween, and thereafter continuously annealing at a range between temperatures of 800° to 1050° C.

6. A method of manufacturing non-oriented magnetic steel strips, comprising the steps of starting a hot rolling on a continuously cast slab which is composed of C: not more than 0.01 wt %, Si: 1.0 to 4.0 wt %, Mn: 0.1 to 0.5 wt %, S: less than 0.005 wt %, Al: not more than 0.01 wt %, P: not more than 0.05 wt %, N: not more than 0.0030 wt %, B: 0.5 to 2.0 in B(wt %)/N(wt %), the balance being Fe and unavoidable impurities, at a state while the surface temperature of the slab has not become lower than 1000° C., or at a state that the slab is reheated to not lower than 1000° C. before the surface temperature of the slab becomes lower than 600° C., and is then soaked at the temperature of not lower than 1000° C. for not less than 10 min, coiling at temperature which is lower than 650° C. following accomplishing the hot-rolling at finishing temperature of 750° to 850° C., subsequently annealing the hot rolled steel strip at a soaking temperature T (°C.) and a soaking time t (min) to satisfy either the following conditions (1) or (2):

$$\left.\begin{array}{l} 770 \leqq T \leqq 890 \\ -100\ln t + 1170 \leqq T \leqq -100\ln t + 1431 \end{array}\right\} \quad (1)$$

$$\left.\begin{array}{l} 890 \leqq T \leqq 970 \\ -100\ln t + 979 \leqq T \leqq -100\ln t + 1069 \end{array}\right\} \quad (2)$$

subsequently performing a one-time cold rolling to said hot rolled steel strip, or performing cold rollings of more than once interposing process annealing(s) therebetween, and thereafter continuously annealing serving as a decarburization annealing at a range between temperatures of 800° to 1050° C., thereby to decrease the C content less than 0.005 wt %.

* * * * *